United States Patent [19]

Comeaux et al.

[11] Patent Number: 5,056,599

[45] Date of Patent: Oct. 15, 1991

[54] METHOD FOR TREATMENT OF WELLS

[75] Inventors: Walter B. Comeaux, Lafayette, La.; Larry Johnson, Lafayette, La.

[73] Assignee: Walter B. Comeaux, III, Lafayette, La.

[21] Appl. No.: 480,246

[22] Filed: Feb. 15, 1990

Related U.S. Application Data

[63] Continuation-in-part of Ser. No. 342,089, Apr. 24, 1989, abandoned.

[51] Int. Cl.[5] ..... E21B 37/06; E21B 34/10

[52] U.S. Cl. ..... 166/310; 137/155; 166/304; 166/321; 166/374; 166/386; 166/902

[58] Field of Search ..... 166/321, 312, 319, 325, 166/902, 324, 310, 304, 374, 386; 137/155; 417/112, 110, 117

[56] References Cited

U.S. PATENT DOCUMENTS

| | | | |
|---|---|---|---|
| 2,465,060 | 3/1949 | Carlisle et al. | 137/155 |
| 2,797,700 | 7/1957 | McGowen, Jr. | 137/155 |
| 2,815,764 | 12/1957 | Bryan | 137/155 |
| 2,982,226 | 5/1961 | Peters et al. | 417/112 |
| 3,066,690 | 12/1962 | Tausch | 137/155 |
| 3,130,743 | 4/1964 | Canalizo | 417/117 X |
| 3,175,514 | 3/1965 | McMurry | 137/155 X |
| 3,542,130 | 11/1970 | Stout | 166/304 X |
| 3,993,129 | 11/1976 | Watkins | 166/319 |
| 4,049,057 | 9/1977 | Hewes | 166/312 X |
| 4,067,350 | 1/1978 | Raggio | 137/155 X |
| 4,450,914 | 5/1984 | Elphick | 166/325 |
| 4,620,597 | 11/1986 | Lamb | 137/155 X |

*Primary Examiner*—Hoang C. Dang
*Attorney, Agent, or Firm*—Keaty & Keaty

[57] ABSTRACT

The invention relates to a valve suitable for use in high-pressure environment for transmitting a treatment fluid from exterior of which is affected by a pre-charged compression gas which keeps the bellows in contracted position and a piston preventing fluid communication between the tubing and the casing through the valve body. The interior of the bellows is affected by the tubing pressure, one half of which is transmitted to the bellows through radial sensing ports, and the other half of which is transmitted to the bellows through the bottom of the piston. When the pressure inside the bellows exceeds the pre-charged pressure, the bellows expands, pulling the piston upwardly and opening fluid communication from the tubing into the casing through the valve. A controlled-size fluid outlet port allows the tubing fluid to exit into the casing.

4 Claims, 2 Drawing Sheets

METHOD FOR TREATMENT OF WELLS

CROSS REFERENCE TO RELATED APPLICATIONS

This application is a continuation-in-part of our copending application,, Ser. No. 342,089 filed on Apr. 24, 1989, now abandoned, the disclosure of which is incorporated herein by reference.

BACKGROUND OF THE INVENTION

This invention relates to an apparatus and method for treating of oil or gas wells for corrosion, removal of paraffin deposits and the like.

One of the problems commonly encountered in the producing oil well is the corrosion of the well tubing and the plugging of the tubing with paraffin, a mixture of heavy hydrocarbons with a relatively high melting point. Corrosion or deposition of paraffin is a gradual process which can eventually clog or create holes in the tubing. It will result in loss of production unless the corrosion and paraffin is removed.

One common method to remove paraffin buildup is to use a well pump to pump hot oil down the casing annulus of the well. The hot oil goes down through the casing annulus all the way to the well pump and is pumped to the surface through the tubing. The hot oil tends to melt the paraffin, so that it is pumped up and out of the well.

Corrosion is traditionally treated by a similar process. However, instead of hot oil corrosion inhibitors are pumped down the casing annulus all the way down to the well pump and then are picked up by the well pump and carried back to the surface through the well tubing. The corrosion inhibitors are designed to coat the inside of the well tubing to prevent corrosion of the tubing in highly corrosive environments, such as water, salt water, acid and/or corrosive gas such as carbon dioxide or hydrogen sulfide.

Since the pump is a rod and/or pump lift system is located at the bottom of the tubing and acts as a plug in the bottom of the tubing. The commonly used procedures described above for treatment of a well for corrosion and paraffin deposit buildup are both time consuming and expensive. In the treatment for paraffin buildup, for example, a large amount of oil has to be heated by a special device on location to a temperature high enough to melt paraffin before it is pumped into the well, so that the oil is still hot enough to melt paraffin when it reaches the well pump and well tubing. A typical hot oil treatment of a typical well under present methods could require up to one hundred barrels of oil heated to 300 degrees fahrenheit. In addition to the heating cost of heating such a large amount of oil to the required temperature, there is also great economic costs involved due to cutting off production of the particular well during the time required to treat the well with hot oil and during the time it takes to recover the oil. The amount of time lost depends on the production rate of the well and the time lost can be up to several days for a slow producing well. For instance, if 100 barrels of hot oil are required under present methods to treat a well that normally produces at the rate of 50 barrels a day, the treatment will require the loss of two days of production while the hot oil that was pumped downhole is being pumped out.

For similar reasons treatment of a well for corrosion requires considerable expense. Under present methods, corrosion inhibitors coat metal surfaces with a layer of protective material to prevent attack of the metal by corrosive liquids. The corrosion inhibitors are pumped into the casing. At the bottom some of the chemicals are picked up by the well pump and are pumped out through the tubing, though much of the expensive corrosion inhibitors are lost in the casing and are not recovered by the pump.

One could easily appreciate the deficiencies of the common method of well treatment through the casing, when only a particular part of the tubing, mainly above the well pump, requires treatment. By using the current methods, most of the well treatment fluid is wasted and not recovered.

Such problems led to the creation of various devices which enable a user to pump oil directly through the tubing, so that the treatment fluid reaches the part of the well tubing that has to be treated, instead of being wasted in the casing annulus. This arrangement not only saves on the amount of treatment fluid, but significantly reduces the time required to treat the well, thus saving on production costs and directly effecting the productivity of the particular well.

Various devices have been offered to allow treatment of the wells directly through the tubing. Some of these devices utilize valves which are spring-operated. However, numerous field tests showed that at high pressure applications the springs tend to break, which defeats the purpose of the valves and causes to spend valuable time to repair or substitute the malfunctioning device.

The present invention contemplates provision of a treating valve and method to enable: 1. treatment of wells even at high pressure and 2. by allowing to pump a treatment fluid through the tubing.

SUMMARY OF THE INVENTION

The present invention overcomes deficiencies of the prior art and achieves its objects in a simple and straightforward manner.

A valve is provided for mounting in a conventional mandrel or in a side pocket mandrel in direct communication with the tubing pressure. The valve has a cylindrical body with a central opening therethrough and a plurality of sensing ports which are open to sense the tubing pressure and at least one fluid outlet port which allows fluid communication between the tubing and the casing when the valve is in its open position. The central opening comprises an upper compression chamber and a lower bellows chamber. The upper chamber is pre-charged on the surface with a compression gas, such as nitrogen. The bellows chamber houses a bellows compression means, which is in the form of a convoluted tube, the exterior of which is affected by the compression gas, and the interior of which is affected by the tubing pressure, which is delivered to the bellows through the sensing ports and the bottom of a piston means. The piston means slidably axially moves in the central opening between a position seated against the valve seat and a position away from the valve seat. In its downward position the piston means effectively closes fluid communication between the tubing and the casing through the valve, because the pre-charged pressure which affects the exterior of the bellows exceed the tubing pressure. When the pressure in the tubing exceeds the pre-charged pressure, the bellows expands, the piston means is pulled away from its downward position, allowing the treatment fluid to be circulated through the tubing, through the valve and displace production fluids into the casing.

It is therefore an object of the present invention to provide a valve suitable for displacement of tubing fluid.

It is another object of the present invention to provide a valve which can be used in deep wells with high hydrostatic pressure.

It is a further object of the present invention to provide a valve which can be installed directly as part of the tubing or in a side pocket mandrel.

It is still a further object of the present invention to provide a valve which opens in response to an upset balance of pressure between the pre-charged pressure inside the valve and the tubing pressure.

These and other objects of the present invention will become more apparent to those skilled in the art from the following detail description of the invention.

BRIEF DESCRIPTION OF THE DRAWINGS

For a better understanding of the nature and operation of the valve in accordance with the present invention, reference will now be made to the drawings, wherein.

DETAIL DESCRIPTION OF THE PREFERRED EMBODIMENT

Figure 1:
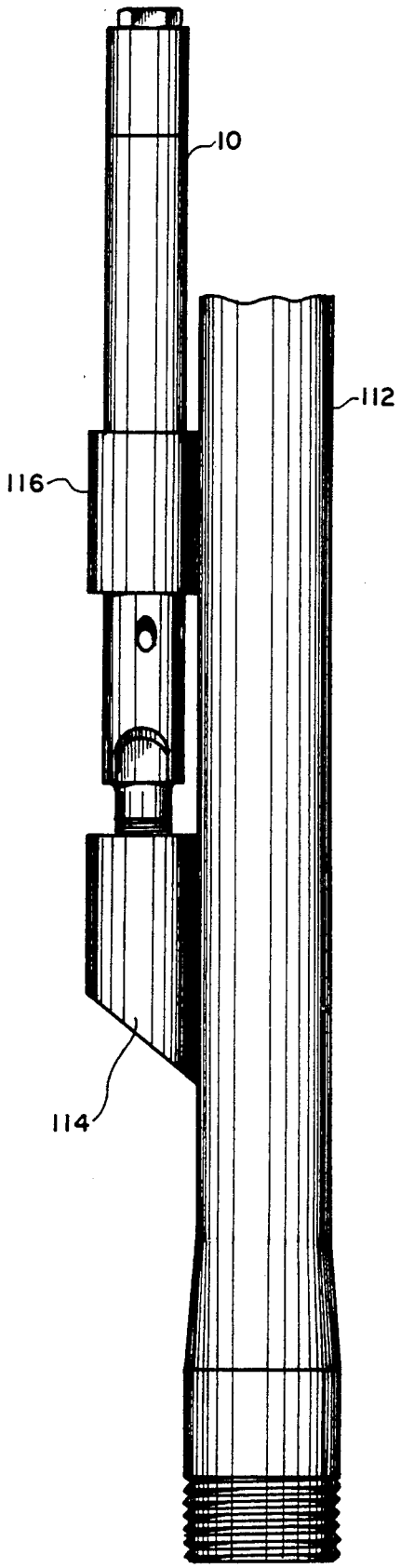
FIG. 1 is an elevational view of the valve in accordance with the present invention.

Referring to the drawings in more detail, wherein like numerals designate like parts, the valve of the present invention is seen designated by numeral 10.

The valve 10 has a dome 12, a dome bushing 14 threadably attached to an upper portion of the dome 12, a stem housing 16, threadably attached to a lower portion of the dome 12, a seat housing 18 threadably connected to a free end of the stem housing 16 and a plug 20 threadably connected to the uppermost part of the dome bushing 14.

The dome 12 is a cylindrical hollow housing having an internal wall provided with an upper threaded portion 22 and a lower threaded portion 24.

In its middle section, the dome 12 has a reduced diameter opening formed by a shoulder 26 extending inwardly from the internal wall.

The upper threaded portion 22 is adapted for connection with matching threads formed on a lower external part of the dome bushing 14. An upper sealing means in the form of two O-rings 30 and 32 seal the area of connection between the dome bushing 14 and the dome 12.

The lower threaded portion 24 is adapted for connection to a matchingly threaded upper external part of the stem housing 16. To prevent leakage, the area of connection between the dome 12 and the stem housing 16 is sealed by suitable lower sealing means in the form of two O-rings 34 and 36.

The upper part of the dome 12 above the shoulder 26 forms an internal nitrogen charge chamber 38, while the lower part below the shoulder 26 forms an internal bellows chamber 40.

The dome bushing 14 has a generally cylindrical hollow shape having an upper internally threaded lower dome bushing portion 42, an externally threaded lower dome bushing portion 44 and a reduced diameter middle dome bushing portion 46. The upper threaded dome bushing portion 42 is adapted to engage with matchingly threaded lower part of the plug 20, while the lower threaded dome bushing portion 44 is adapted for engagement with the upper threaded portion 22 of the dome 12, as was described above.

Fitted within the internal opening formed by the middle dome bushing portion 46 is a valve core 48, which is a one-way valve adapted to facilitate injection of nitrogen charge, as will be described in more detail hereinafter.

Mounted within an opening formed by an upper dome bushing portion 42 is a lower end 50 of the plug 20, which engages the internal threads of the dome bushing upper portion. To prevent leakage, the area of connection between the lower end 50 of the plug 20 is sealed by suitable sealing means in the form of two O-rings 52 and 54.

The top part 56 of the plug 20 rests on the upper edge of the dome bushing 14, and since it has a diameter larger than the diameter of the internal opening formed by the upper dome bushing portion 42, it effectively closes the opening, thus containing the nitrogen charge within the dome 12.

The top part 56 can be conveniently hexagonally shaped, so as to facilitate engagement by a wrench, when the plug is positioned on the dome busing 14.

The stem housing 16 is generally cylindrically shaped and is provided with upper externally threaded part 58 and a lower externally threaded part 60, which are adapted for threaded engagement with matchingly threaded portions 24 of the dome 12 and threaded portion 62 of the seat housing 18, respectively.

A plurality of sensing ports 64 are equidistantly spaced about the circumference of the stem housing 16, in the middle part thereof, the ports 64 extending from the outside of the stem housing 16 into the interior chamber formed by the stem housing. In the embodiment described herein, it was found that four sensing ports 64 positioned at 90 degrees to each other present a suitable arrangement.

The seat housing 18 has a lower externally threaded portion 66 adapted for engagement with a lug carried by a tubing mandrel and an upper internally threaded part 62 which is adapted for engagement with a threaded portion 60 of the stem housing 16.

The internal wall of the seat housing 18 is provided with a lower upwardly facing horizontal shoulder 70, an intermediate angularly inclined shoulder 72 and an upper upwardly facing horizontal shoulder 74. The shoulders 70, 72 and 74 are positioned above the threaded part 66.

The exterior of the seat housing 18 is further provided with a hexagonally-shaped wall portion 76 adapted for engagement by a wrench or other suitable torque applying device, which facilitates threaded engagement of the valve 10 with a lug 114 mounted on tubing mandrel.

At least one fluid outlet port 78 is formed in the wall of the seat housing 18, the fluid outlet port 78 extending through the wall of the seat housing 18 into an internal central opening 80 formed by the internal wall of the seat housing 18.

The fluid outlet port 78 extends at an angle to a vertical axis of the valve 10 and allows fluid communication between the valve 10 and well tubing 112, when the valve 10 is in its open position. The embodiment discussed herein provides for the use of three fluid outlet ports 78 spaced about the circumference of the seat housing 18.

Although not shown in the drawings for the sake of clarity of the drawings, a choke with a small outlet area is fitted within each fluid outlet port 78, so as to take in some of the pressure drop when the valve 10 opens and to relieve the ball 94.

Fitted between the lower shoulder 70 and the intermediate shoulder 72 is an annular valve seat 82, which is retained in its position by a snap ring 84, which is inserted in a groove formed by the inclined intermediate shoulder 72. The valve seat 82 is sealed against leakage by an O-ring 86 fitted between the valve seat 82 and the seat housing 18 above the lower shoulder 70.

Mounted in the internal central opening 88 of the valve 10 is a ball stem assembly 90 which comprises an elongated stem 92 and a ball 94 rigidly attached, such as by welding, to the lowermost part of the stem 92. In its upper part, the stem 92 is provided with externally threaded portion 96 which engages with a matchingly threaded lower portion 98 of the bellows stem 100. A ball stem assembly seal 91 is positioned in the groove formed in the body of the stem 92 below the threaded portion 96. The seal 91 prevents the tubing pressure from affecting the portions of the valve 10 below the seal 91.

The external diameter of the stem 92 is slightly smaller than the internal diameter of the opening formed by the stem housing, so that at least in some part, the stem 92 frictionally engages the internal wall of the stem housing 16 through the seal 91. Similarly, the external diameter of the bellows stem 100 in its lower part is slightly smaller than the internal diameter of the central opening of the stem housing 16.

The diameter of the ball 94 is slightly larger or equal to the diameter of the central opening of the seat 82 and smaller than the snap ring 84. In a closed position of the valve 10, the ball 94 contacts the upper end of the seat 82, blocking any fluid communication between the lower part of central valve opening 88 and fluid outlet port(s) 78.

The elongated bellows stem 100 which extends through the central opening 88 above the ball stem assembly 90 has a reduced diameter upper part 102 which extends opposite the shoulder 26 formed by the dome 12, an upper downwardly facing shoulder 104 and a lower downwardly facing shoulder 106.

When the valve 10 is in its closed position, the shoulder 106 is positioned slightly above the uppermost edge of the stem housing 16. A second reduced diameter part 108 is formed between the shoulders 104 and 106.

The annular bellows chamber 40 is formed between the exterior of the part 108 and internal wall of the dome 12. Mounted within the bellows chamber 40 is a bellows 110, which at its uppermost end is attached by brazing to the shoulder 104 of the bellows stem 100. The lowermost end of the bellows 110 is attached to the uppermost edge of the stem housing 16.

The bellows 110 is a thin convoluted tube which acts as a diaphragm or a "seal" forcing the ball 94 into its seated position. At such time the bellows 110 is contracted. The inside of the bellows 110 is affected by the pressure present in the tubing, while the outside of the bellows is affected by the pressure created by the nitrogen charge. When the bellows 110 is in its contracted position (valve 10 is closed), a relative balance exists between outside pressure (dome pressure) and the inside pressure (tubing pressure). When the valve 10 is in its open position, the bellows 110 is expanded, pulling the ball 94 from its seated position against the valve seat 82, thus opening a fluid communication between the central opening 88 and the fluid outlet port(s) 78.

In operation, the valve 10 is prepared on the surface for positioning in an oil well. Depending on the depth at which the valve 10 is designed to be positioned, the pressure in the dome (the nitrogen pressure) can be varied. The plug 20 helps to effectively contain that pressure, not relying only on the seals. Some of the bellows fluid, which was not displaced and forced out through the ports 64 into the tubing, remains in the valve 10 for protection of bellows. The plug 20 is then secured in place, retaining the nitrogen within the interior of the valve 10.

A tubing mandrel 112 is assembled by welding a lug 114 to a side of the mandrel 112 and by welding a retaining sleeve 116 to the mandrel 112 in coaxial alignment above the lug 114.

The lug 114 has a closed bottom 118 and an open top 120. A central opening is formed in the lug 114, with the upper part of the opening having threads 122 which match the lower external threads 66 of the valve 10. An angularly inclined fluid outlet passageway 124 is formed between the central opening of the lug 114 and interior of the mandrel 112.

The cylindrical retaining sleeve 116 has open top and bottom with a central opening 126 extending through the length thereof. The internal wall of the sleeve 116 is formed with a plurality of grooves 128 suitable for positioning of sealing means therein. A sensing port passageway 130 allows fluid communication between the sensing ports 64 and interior opening of the mandrel 112. The diameter of the central opening 126 is made conveniently greater than the exterior diameter of the valve 10, so as to form an annular chamber around the valve 10, fluidly isolating the chamber by the sealing means positioned within the grooves 128.

The valve 10 is mounted in the lug 114 and the sleeve 116 carried by the mandrel 112 in such a manner that the fluid outlet 78 is aligned with the fluid outlet passageway 124 of the lug 114, while the sensing ports 64 are aligned with the sensing port passageway 130 of the retaining sleeve 116.

Figure 2:
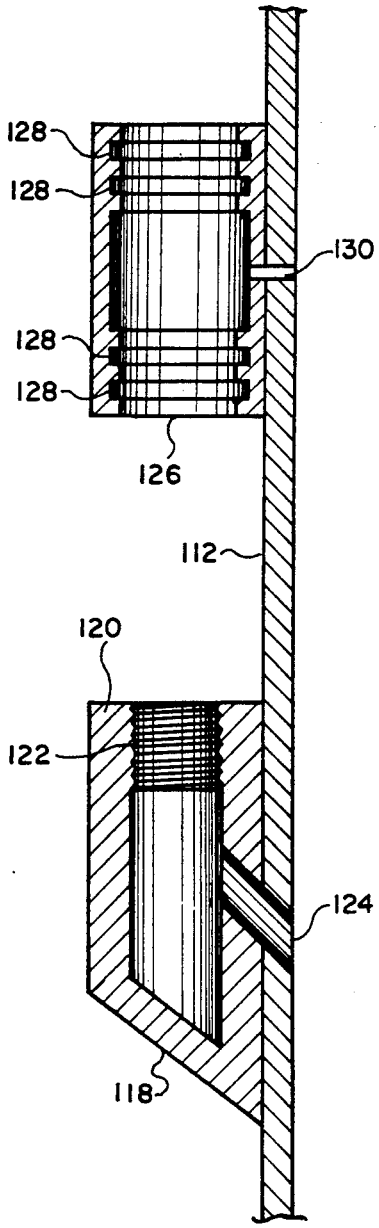
FIG. 2 is an elevational, partially cross-sectional view of the valve in a closed position.

The mandrel 112 is mounted as part of a well tubing in a well known manner. Alternatively, the valve 10 can be mounted in a side pocket mandrel. When valve 10 is positioned in the tubing, it is in its closed position illustrated in FIG. 2.

The nitrogen charge acts on the cross-sectional area of the bellows 110 forcing them to contract and keep the ball 94 seated. The inside of the bellows has the same pressure as the tubing, since this pressure is communicated through the sensing ports 64. The same tubing or production pressure acts on the bottom of the ball 94 coming through the mandrel 112 into the seat housing. As a result, the pressure is applied through the ball stem assembly 90 and through the sensing ports 64, i.e. the pressure is applied against 100 percent of the area of the bellows.

It has been found that should the pressure not be applied against the total area of the bellows, an unbalanced situation will occur and a significantly more pressure will be required for displacement of fluid from the tubing into the casing. Additionally, throttling of the valve may occur, which is always an undesirable occurrence. When the pressure is applied against the total area of the bellows, the valve 10 opens and stays open without a tendency to throttle. However, if the pressure is applied only against the ball stem assembly, the valve opens momentarily and then tends to close between the pump strokes, which results in wearing off of the ball 94 and the seat 82 which come into frictional contact.

When the valve 10 is closed, the pressure in the casing has no opening or closing effect on the valve, since there is a force created by the casing pressure acting on the ball stem seal 91. As will be appreciated, the area of the stem seal 91 is substantially equal to the area of the seat 82. The casing pressure acting on the bellows stem 100 as applied to seal 91 is cancelled out as a result of pressure on the ball stem assembly 90.

As we described above, the tubing pressure is communicated in two ways to the bellows 110: through the bottom of the ball 94 and through the sensing ports 64. In this manner, the valve 10 achieves a more sensitive indication of the tubing pressure acting on the inside of the bellows 110. As a result, the valve reacts faster on a pressure change in comparison with situation, when the pressure acts only on the ball stem assembly.

Figure 3:
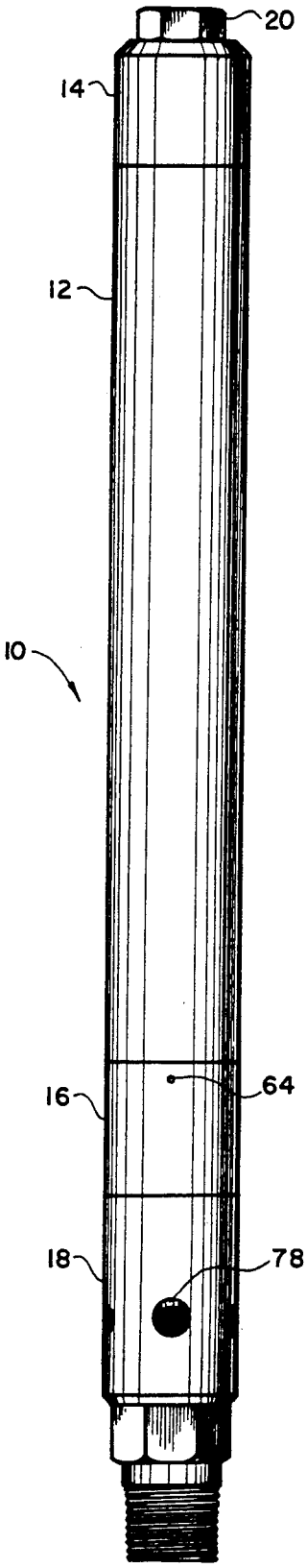
FIG. 3 is an elevational, partially cross-sectional view of the valve in an open position.
Figure 4:
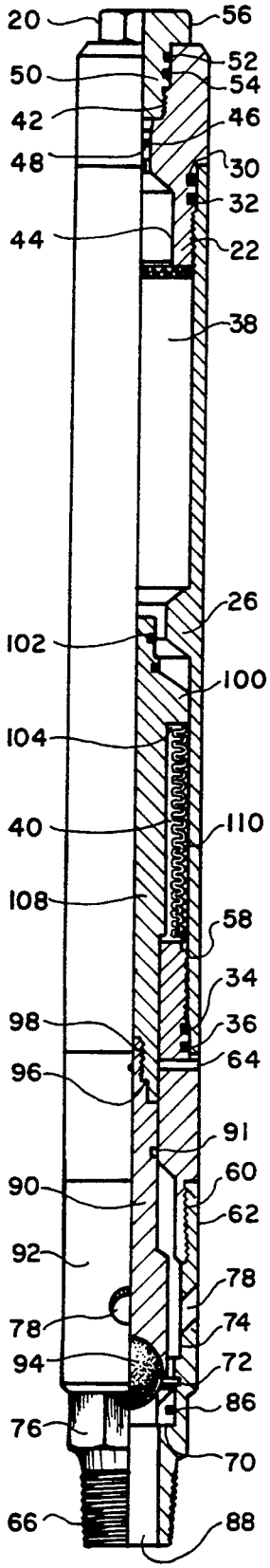
FIG. 4 is an elevational view of the valve mounted on a mandrel.
Figure 5:
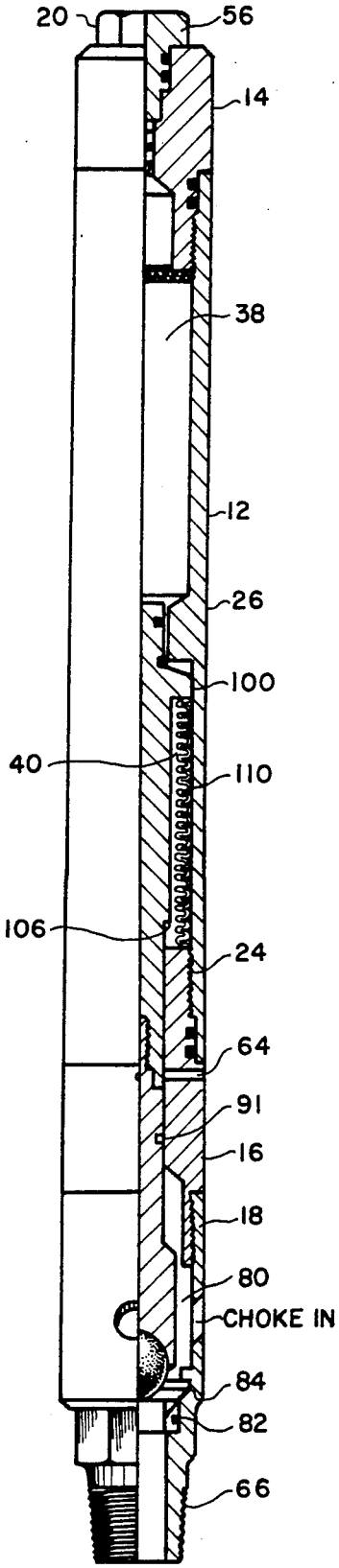
FIG. 5 is a cross-sectional detail view illustrating fluid communication of the valve with mandrel.

When the pressure in the tubing sufficiently increases to a predetermined value and exceeds the pressure exerted by nitrogen charge on the outside of the bellows 110, the piston means (the ball stem assembly 90 and the bellows stem 100) slides axially upwardly, unseating the ball 94, thus forming a fluid communication between the valve 10, the tubing and a casing through the fluid outlet port(s) 78. The bellows 110 at such time expands, shoulder 106 of the bellows stem moves upwardly, away from the uppermost edge of the stem housing 16, as illustrated in FIG. 3.

When it is necessary to treat the tubing for paraffin build-up or prevention, or elimination of erosion, the treatment fluid is introduced into the tubing, displacing the fluids which was in the tubing immediately prior to the treatment process. The tubing fluid is allowed to enter the valve 10 from the bottom of the central opening 88 and to move pass the seat 82 into the fluid outlet port 78. The tubing fluid then exits the tubing and into the casing.

The fluid outlet port 78 has a smaller area than the seat 82, so that when the valve 10 opens, there is still tubing pressure acting against the ball 94, but the fluid outlet port 78 takes some of the pressure drop, thus decreasing damage to the ball 94 and the seat 82. By narrowing the fluid outlet port and controlling its size through the use of a choke, the valve 10 is kept open despite a rapid drop of pressure after communication with the casing has been established.

By effectively changing the balance between the area of the bellows 110 and the surface area of the stem seal 91, the valve 10 of the present invention can be easily adapted for use at various depth wells, for example 0–12,000 feet.

The valve 10, by having the bellows 110 and using nitrogen pressure acting on the outside of the bellows 110, has distinct advantages over spring operated valves. The springs tend to break and loose rating memory at high pressure application, which forces one to use very long springs and create frequent valve failure. Springs also increase a chance of throttling damage to ball and seat.

The provision of the bellows becomes especially important at high pressure application or where large seats are important. Under certain circumstances, when the treatment time has to be reduced to a minimum, the large seats allow to pump the treatment fluid at higher rates through the valve 10. The valve 10, after being installed in the tubing string of the production well, allows the treatment fluid to be pumped from the tubing into the casing at pressure higher than the normal production pressure in the tubing.

The valve 10 of the present invention can be used for removal of paraffin build-up, for corrosion treatment or other similar applications. The valve 10 can be also used to displace production fluid through the valve, so as to leave a clean workover fluid in the tubing in case is the tubing needs to be pulled with the well fluids spilling on the ground.

The valve 10 can be used to displace hot production fluids in steam flood wells to prevent pulling of a wet string with hot water which may create hazardous conditions at a production site. Generally, the valve of the present invention can be used at any time when it is necessary or desirable to displace fluid from the tubing into the casing.

Many changes and modifications can be made in the device of the present invention without departing from the spirit thereof. We, therefore, pray that our rights to the present invention by limited only by the scope of the appended claims.

We claim:

1. A method of displacing fluid from a tubing of a well into a well casing, comprising the steps of:

providing a valve means having a substantially cylindrical body with a central opening axially extending through the body;

providing an upper compression chamber and a lower bellows chamber within said valve body;

providing a bellows compression means mounted within said bellows chamber;

providing a piston means within said central opening movable in response to an upset balance between a tubing pressure and pressure within said upper compression chamber;

providing means for sensing the tubing pressure and transmitting the tubing pressure to the bellows compression means;

providing a fluid outlet means allowing fluid communication between the tubing and the casing through said valve body, said fluid communication being normally prevented by a downward position of the piston means;

providing means for controlling a flow of fluid through a fluid outlet means;

charging said compression chamber with a compression gas by applying said compression gas on exterior of the bellows compression means, which transmits a downward force on said piston means keeping the valve in its closed position;

positioning the valve in the tubing, while the valve is in its closed position;

increasing the tubing pressure inside said bellows compression means, causing the bellows compression means to expand and move the piston means upwardly, thus opening the fluid communication between the tubing and the casing;

admitting the tubing fluid through an open bottom end of the central opening; and displacing the tubing fluid into the casing while restricting the flow of fluid through said fluid outlet means, so as to prevent closing of the valve immediately after communication with the casing has been established.

2. The method of claim 1, wherein said valve body further comprises an annular valve seat mounted in the central opening below said fluid outlet means.

3. The method of claim 1, wherein said fluid outlet means comprises a means to control a fluid flow through said valve body.

4. The method of claim 1, wherein said piston means comprises a ball seated against said valve seat when the valve is in its closed position, a ball stem fixedly attached to said ball and extending through at least a portion of said central opening and a bellows stem fixedly attached to a free upper end of said ball stem, wherein said bellows compression means is fixedly attached to an opposite end of the bellows stem.

* * * * *